United States Patent [19]

Meriweather

[11] Patent Number: 4,945,595

[45] Date of Patent: Aug. 7, 1990

[54] MODULAR RAMP ASSEMBLY

[75] Inventor: Jon D. Meriweather, Follansbee, W. Va.

[73] Assignee: The Louis Berkman Company, Follansbee, W. Va.

[21] Appl. No.: 373,275

[22] Filed: Jun. 29, 1989

[51] Int. Cl.[5] ..... E01D 1/00

[52] U.S. Cl. ..... 14/69.5; 14/71.1; 404/43; 404/221

[58] Field of Search ..... 14/69.5, 71.1; 404/35, 404/43; 405/219, 220, 221; 114/230, 258, 263, 362

[56] References Cited

U.S. PATENT DOCUMENTS

| | | | |
|---|---|---|---|
| 3,861,340 | 1/1975 | Clingenpeel | 405/218 X |
| 3,999,397 | 12/1976 | Albery | 14/69.5 X |
| 4,079,476 | 3/1978 | Green | 14/69.5 |
| 4,581,784 | 4/1986 | Rousseau et al. | 14/71.1 |
| 4,807,317 | 2/1989 | Quinn et al. | 14/69.5 |

*Primary Examiner*—William P. Neuder

*Attorney, Agent, or Firm*—Body, Vickers & Daniels

[57] ABSTRACT

A lightweight pedestrian ramp assembly for bridging a span of open water between two marine structures is readily adaptable in length and width to meet existing site requirements. The ramp assembly is constructed of successive elongated ramp units, each of which is in turn constructed of adjacent, elongated channel shaped fiberglass modules defining a planar walking surface across the backs of the channel webs.

29 Claims, 11 Drawing Sheets

FIG. 11
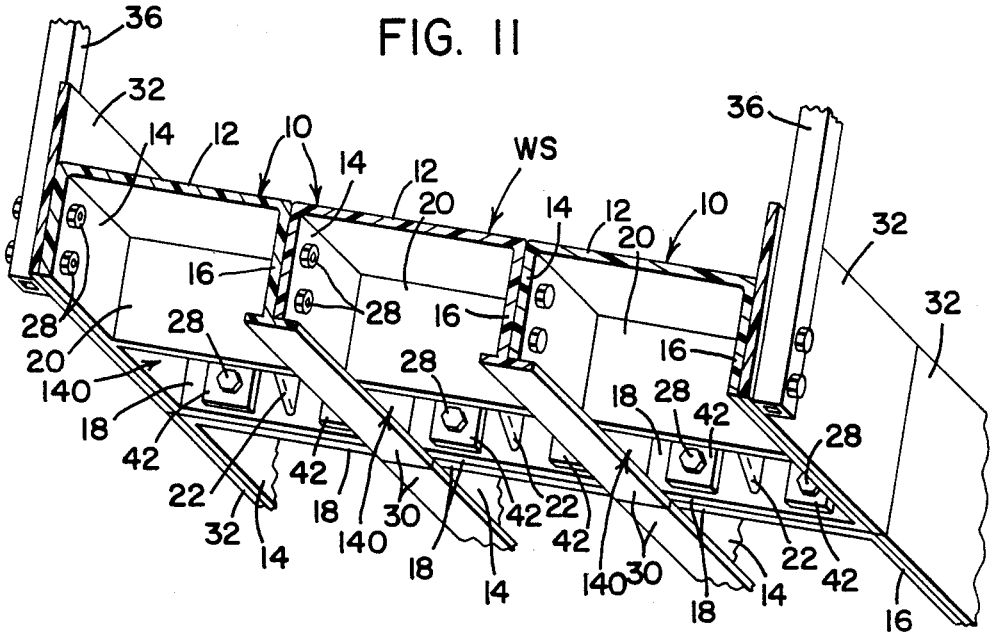
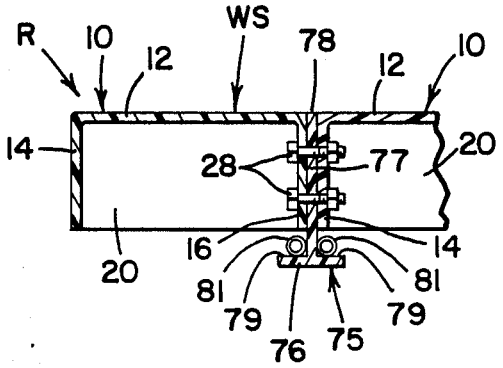
FIG. 12

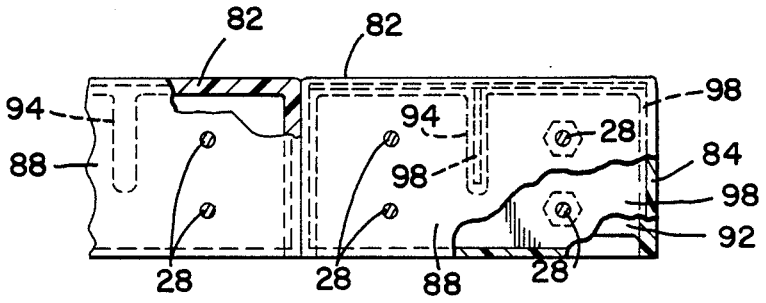
FIG. 15
FIG. 16
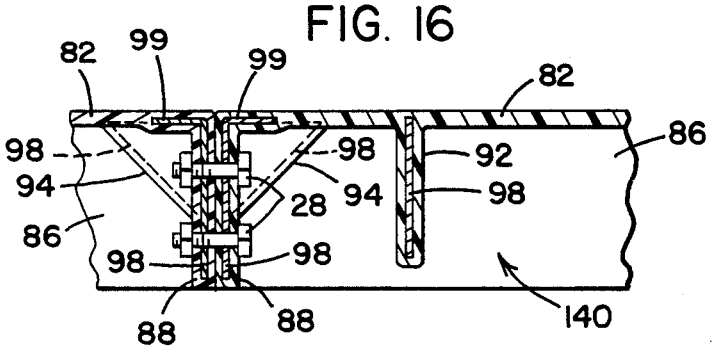
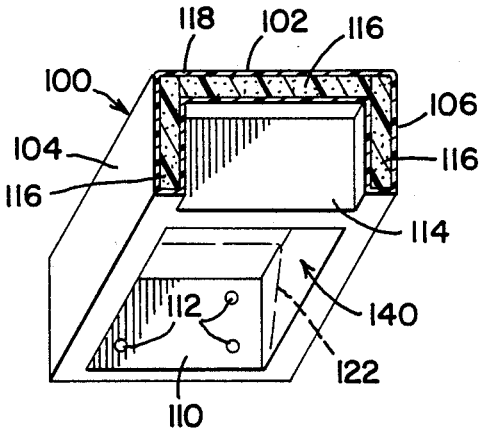
FIG. 17

FIG. 18
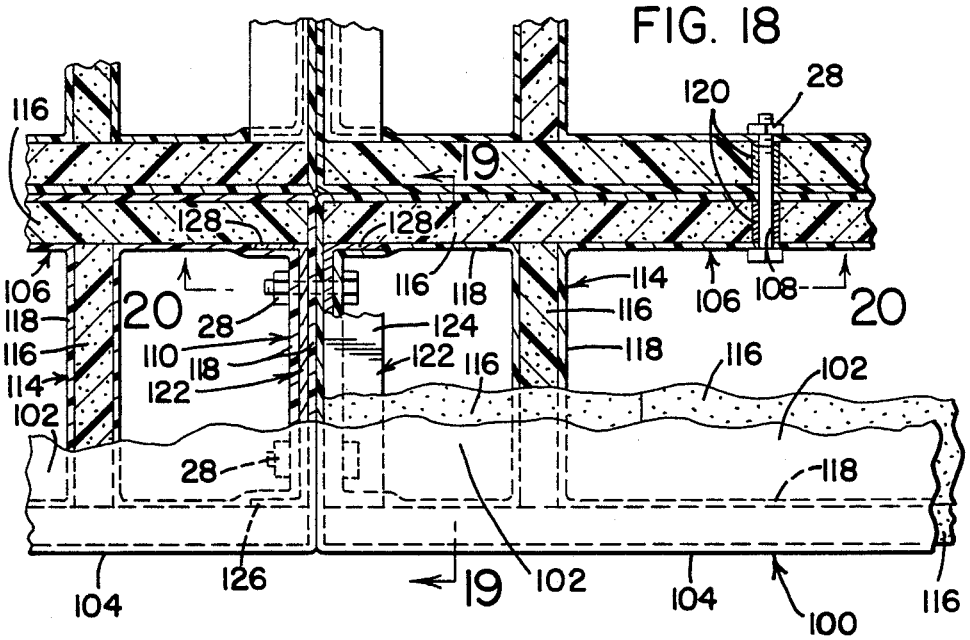
FIG. 19
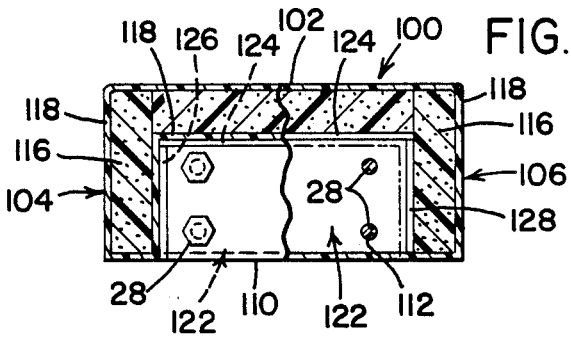
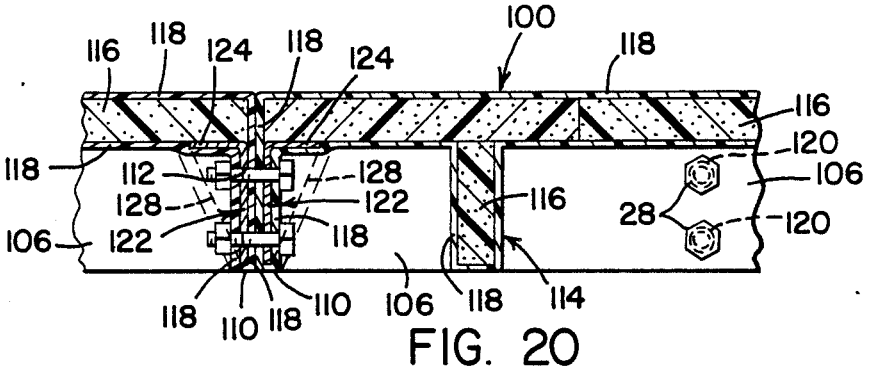
FIG. 20

MODULAR RAMP ASSEMBLY

The present invention pertains to pedestrian bridges, and particularly to a modular pedestrian ramp extending between marine structures such as piers and docks.

BACKGROUND OF THE INVENTION

Pedestrian access to boats moored in a marina is often provided between a pier or other waterfront structure and the boats by means of a floating dock having a pedestrian walkway extending along side a row of mooring stations for the boats. Consequently, the need arises for a pedestrian bridge between the pier and the floating dock to complete the walkway between the boats and the shore. Pedestrian bridges known to be used for this purpose generally comprise a ramp extending at an incline between the floating dock and the raised pier. Such ramps may be of wooden construction, but in order to span extended distances across the water without intermediate structural supports such as trusses or columns associated with more elaborate bridge structures, the ramps are commonly formed of steel or aluminum. However, metal ramps suffer from several disadvantages as they are somewhat incompatible with the conditions surrounding use of a pedestrian walkway in a marine environment.

Specifically, metal ramps are known to be formed in a single unitary piece extending between the opposite ends. Unless custom made, they are consequently manufactured and available only in standard lengths and widths. This may often require that the location and dimensions of the floating dock be made to accommodate the available ramp dimensions, as opposed to the converse situation wherein a ramp will be selected to meet the preferred location of the floating dock. This is an important consideration in the construction of a pedestrian walkway between the shore and the moored boats since the location of a floating dock is determined in consideration of the layout of the entire marina, and should not be critically dependent upon a single element such as the pedestrian ramp. Furthermore, known unitary ramps of any substantial length are extremely costly to ship from the factory to the site, particularly when the elongated ramps dominates the space available on a truck or rail car.

Other disadvantages of known steel or aluminum pedestrian ramps are caused by the metal material itself. Metal is obviously a heavy material which makes handling and installation of the ramp difficult in most circumstances. Beyond the usual problems associated with excessive weight, there is the additional problem of maintaining floatation when one end of the ramp rests atop a floating dock. The dock should be at least generally level along its length in order to provide a convenient pedestrian walkway, and likewise should rise and fall in response to wave action consistently along its length. An excessive weight load imposed at one spot by the ramp could easily interfere with those floatation features of the dock. Furthermore, metals tend to corrode in both fresh and salt water environments, and as electrical conductors they may pose a particular safety hazard with respect to lightning or electrical utilities extended from the shore outwardly to the floating dock.

The prior art is thus seen to fail to provide a pedestrian ramp for spanning the water between a floating dock and a pier or other land based structure which is adaptable in length and width to accommodate existing dock and pier conditions, or which is lightweight and electrically nonconductive.

SUMMARY OF THE INVENTION

The present invention overcomes the above described disadvantages and others and provides a pedestrian ramp for use in a marine environment which is inexpensive, safe, and easy to install. In accordance with a principal feature of the invention, there is provided a modular ramp assembly having first and second ends, and comprising a plurality of elongated, rectangular channel shaped modules in a laterally adjacent arrangement with the backs of the channel webs defining a planar walking surface extending between the two ends. Use of separate modules to construct the ramp assembly advantageously permits variations in length and width not attainable with unitary ramp assemblies, and forming the modules as elongated rectangular channels provides the ramp assembly with strength across an extended span.

In accordance with a more specific feature of the invention, the modules are comprised predominantly of a fiberglass material. This feature of the invention advantageously provides a high strength, lightweight, electrically nonconductive structure. The use of fiberglass in the marine environment of the present invention provides extraordinary advantages beyond those ordinarily expected of fiberglass as a structural material since the ramp assembly faces unique requirements of light weight where it rests atop the floating dock, and as an electrical insulator the fiberglass will especially protect against lightning or other electrical hazard as it spans the open water.

Another specific feature of the invention is the provision of lateral stiffeners extending across the interior of the channel shaped modules between the side flanges or walls. In addition to adding strength, the stiffeners define interior sections which serve as downwardly open air pockets should the modules be dropped into the water. Although structural fiberglass material might not be buoyant enough to float atop the surface, it is considerably more buoyant than steel or aluminum, and in combination with the structural arrangement of stiffeners and air pockets it provides a ramp which is far easier to handle in or to retrieve from the water.

In accordance with another specific feature of the invention, the modules making up the ramp assembly are arranged in one or more rectangular units, with each unit comprising a plurality of laterally adjacent modules of equal length. The units may be of the same or differing lengths, and beneficially enable the construction of an extended span as a combination of connected units without requiring any single piece to extend the entire length of the span.

In accordance with yet another specific feature of the invention, a rectangular unit of the ramp assembly may be comprised of laterally adjacent modules of unequal length. This feature of the invention provides a staggered layout of elongated modules whereby a single unit may be constructed with a length greater than any one of the individual modules. This is an alternate means of constructing a lengthy ramp assembly without requiring any one of the individual components to extend the entire length of the span. Furthermore, a staggered layout of modules avoids a connecting joint extending entirely across the width of the ramp assembly and thus provides greater bending strength.

Still another feature of the invention calls for one end of the elongated ramp assembly to be connected to a structure such as a pier or other land based structure by means of a connection which constrains the ramp assembly from horizontal movement relative to that structure, but which permits vertical pivotal movement of the ramp assembly relative thereto. The pivotal connection of the ramp assembly to the land based structure permits the opposite end of the ramp to move vertically with the floating dock in response to tides or wave action.

The principle object of the present invention is to provide an improved pedestrian ramp for spanning a section of open water which is inexpensive, lightweight, and easy to install.

Another object of the present invention is to provide a pedestrian ramp which is adaptable in length and width to accommodate various existing conditions requiring a ramp to bridge a span of open water between two spaced structures.

Yet another object of the present invention is to provide a pedestrian ramp as defined above which has sufficient strength to extend a substantial distance across open water and yet is sufficiently light in weight to rest atop a floating dock without interfering with the buoyancy thereof.

Still another object of the present invention is to provide a pedestrian ramp as defined above which is electrically nonconductive and consequently safe in environments exposed to lightning or other electric shock.

These and other objects of the invention will become apparent from the following description of the preferred embodiments thereof taken together with the accompanying drawings.

BRIEF DESCRIPTION OF THE DRAWINGS

FIG. 11 is a partial pictorial view of the assembly shown in FIG.. 2 taken in cross section;

FIG. 12 is a partial cross sectional view of an alternate embodiment of a modular pedestrian ramp assembly in accordance with the present invention;

FIG. 15 is a cross sectional view taken along line 15—15 of FIG. 14;

FIG. 16 is a partial sectional view taken along line 16—16 of FIG. 14;

FIG. 17 is a partial pictorial view, taken in cross section, of yet another alternate embodiment of the present invention;

FIG. 18 is a partial top view, partially in section, of a modular pedestrian ramp assembly in accordance with the embodiment of FIG. 17;

FIG. 19 is a partial cross sectional view taken along line 19—19 of FIG. 18;

FIG. 20 is a partial side view taken along line 20—20 of FIG. 18;

DESCRIPTION OF THE PREFERRED EMBODIMENTS

Figure 1:
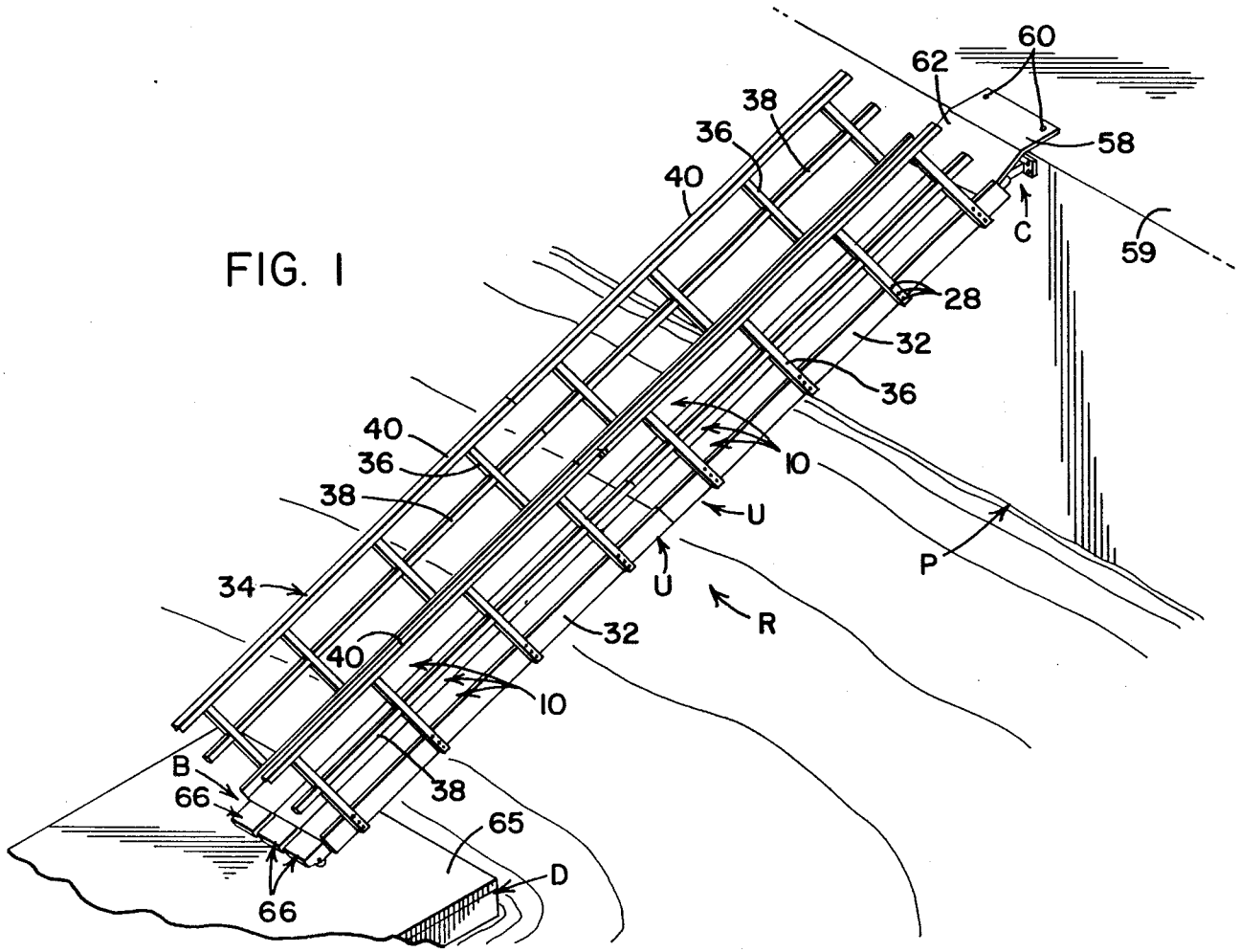
FIG. 1 is a pictorial view of a modular pedestrian ramp assembly in accordance with the present invention.
Figure 2:
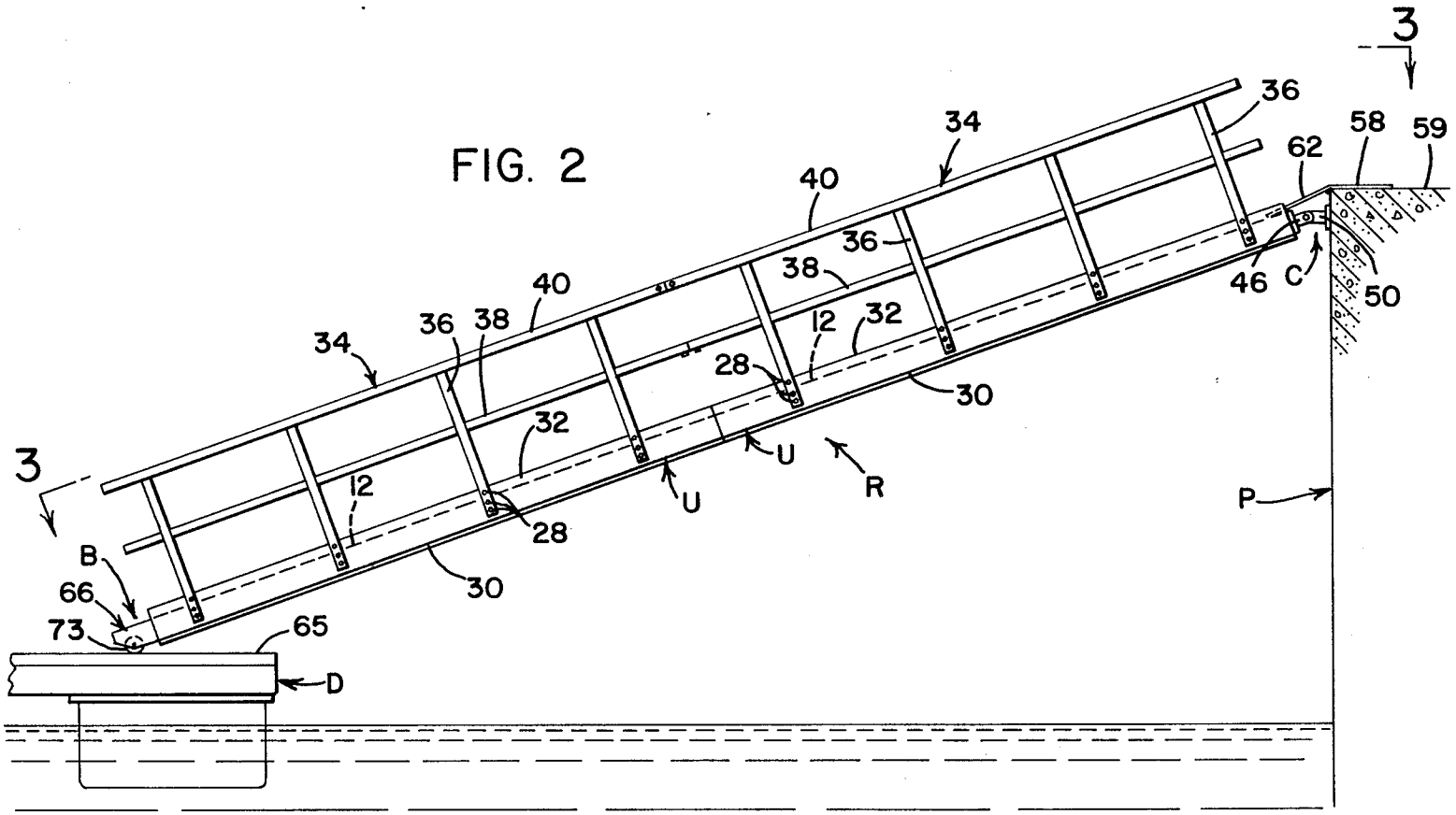
FIG. 2 is a side view of the assembly of FIG. 1.

Referring now to the drawings wherein the showings are for the purpose of illustrating the preferred embodiments of the invention and not for the purpose of limiting same, in FIG. 1 there is shown a modular pedestrian ramp assembly R spanning a section of open water between a floating dock D and a pier P. The lower end of the modular ramp assembly R rests atop the floating dock D such that the dock may shift slightly with respect to the ramp, and the upper end is pivotally connected to the pier P by means of a connecting assembly C so that the modular ramp assembly R can move vertically with the floating dock D in response to wave action or tides.

Figure 3:
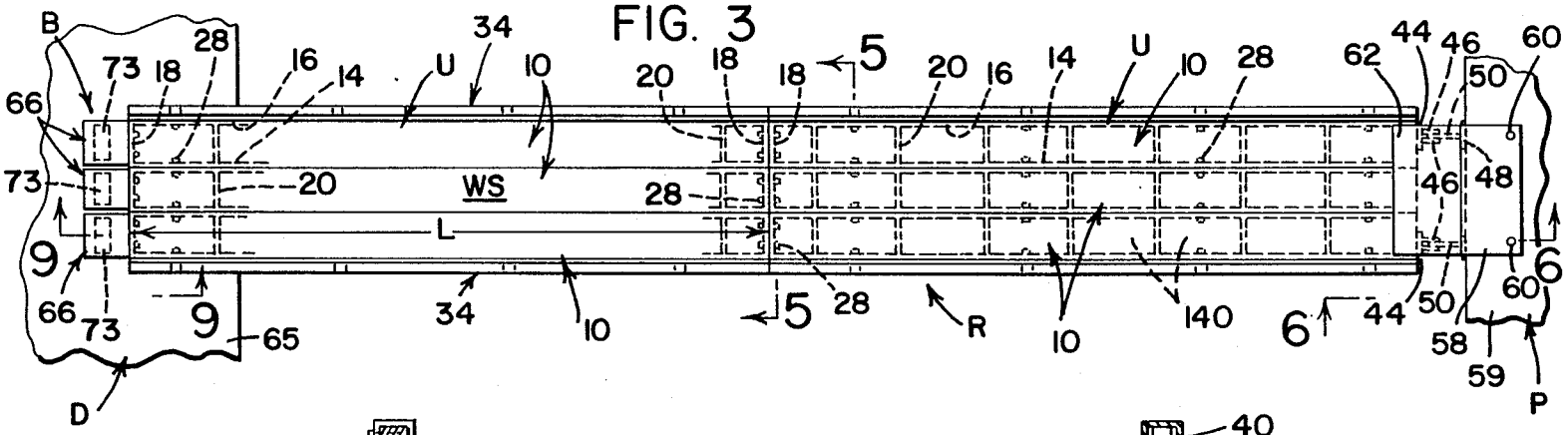
FIG. 3 is a top view taken along line 3—3 of FIG. 2.
Figure 5:
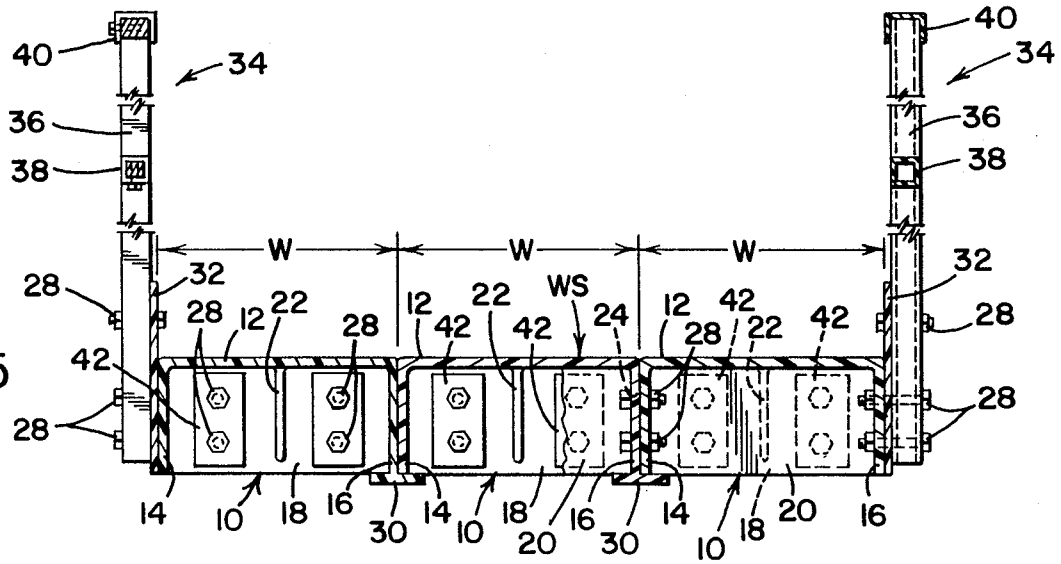
FIG. 5 is a cross sectional view taken along line 5—5 of FIG. 3.
Figure 4:
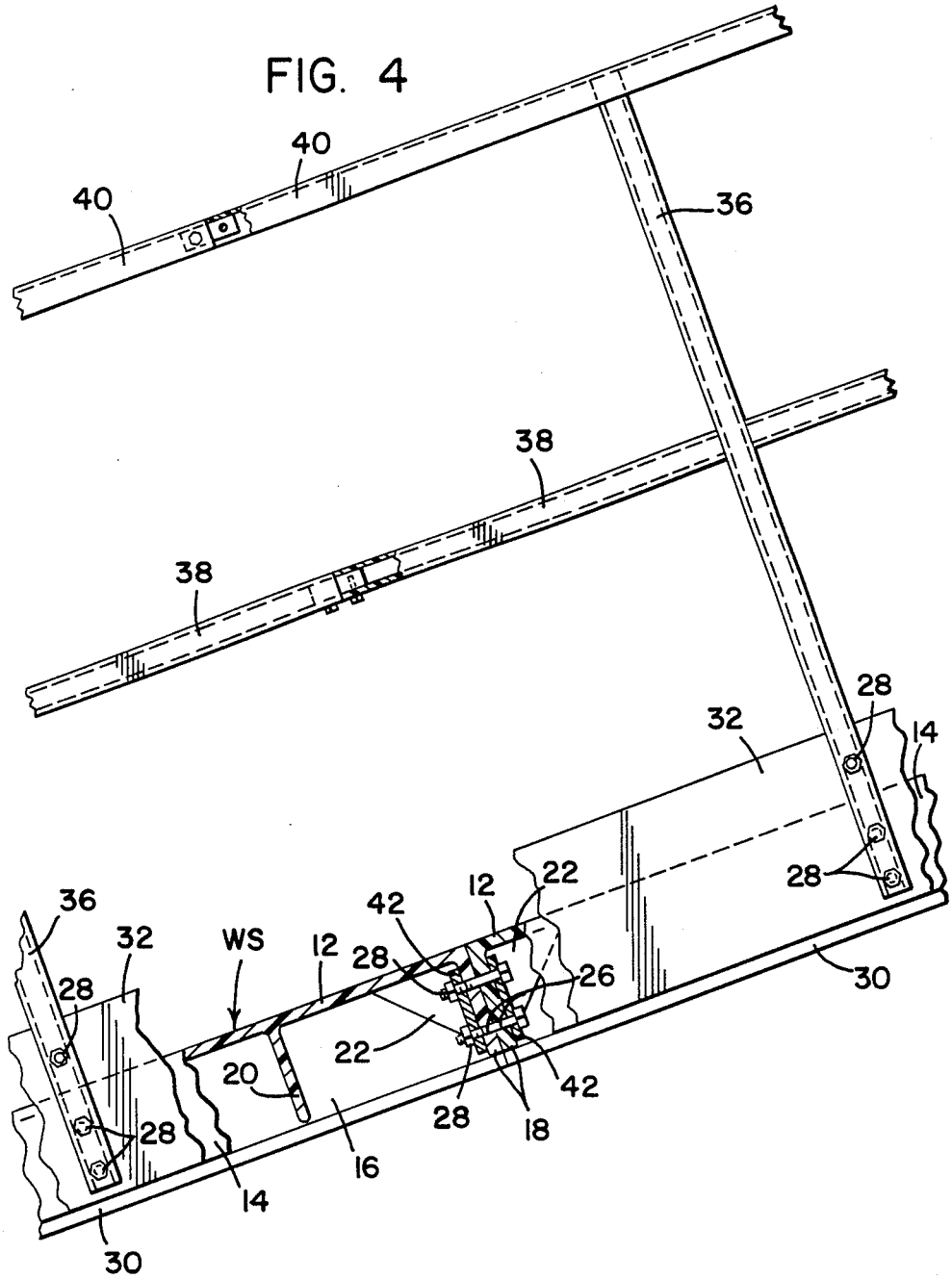
FIG. 4 is an enlarged partial side view, partially in section, of the..assembly shown in FIG. 2.

Referring more specifically to FIGS. 3 through 5, the modular ramp assemble R is comprised of a plurality of modules 10 formed of a fiberglass material. Each module 10 is an elongated rectangular element having a length L, a width W, and a channel shaped cross section defined by a horizontal web 12 and a pair of vertical side flanges 14 and 16 of equal height. An end plate 18 closes each end of the elongated channel, and internal structural support is provided by lateral stiffeners 20 and longitudinal stiffeners 22 as shown. Laterally extending bolt holes 24 are disposed along the vertical side flanges 14 and 16 in aligned pairs, and longitudinally extending bolt holes 26 are likewise disposed at the end plates 18. Each module 10 is thus adapted to be arranged as one of several laterally adjacent components of a rectangular modular ramp unit U having a length equal to the module length L and a combined total width defined by the number of adjacent modules 10 each of width W. The modular units U thus provide a planar walking surface WS along the backs of the channel webs 12 which is flush without tripping hazards across the length L and width W. A sheet of skid resistant material 27 may be applied to the walking surface WS.

As components of a modular ramp unit U, the modules 10 are firmly held together by means of bolts 28 secured through the laterally extending bolt holes 24. In accordance with the preferred embodiment of the invention and as specifically shown in FIG. 5, all but one of the modules 10 along the cross section of the modular ramp assembly R include a horizontal flange 30 extending longitudinally between the end plates 18 along the lower edge of the right hand vertical side flange 16. The horizontal flanges 30 are each adapted to register with the lower edge of the adjacent left hand vertical side flange 14 to provide supplemental structural support for the bolted connections and, in order to provide a simplified structural outline in accordance with the preferred embodiment, are not provided at the outer edges of the modular assembly.

Each modular ramp unit U is further adapted to serve as a component of the modular ramp assembly R by the provision of a pair of fiberglass kick plates 32 extending along the length of the unit U to provide footing safety and to confine dropped objects from falling into the water. Also provided is a fiberglass handrail assembly 34 comprising vertical posts 36 bolted to the modules 10 at the laterally extending bolt holes 24, rectangular horizontal support members 38 extending between the vertical posts 36, and channel shaped horizontal handrail members 40 extending across the tops of the vertical posts 36. The modular ramp units U are connected together as individual components of the modular ramp assembly R by means of bolts 28 secured through the longitudinally extending bolt holes 26 at the end plates 18. Metal plates 42, preferably galvanized steel, are provided to support the bolted fiberglass end plates 18 against the bending moment forces developed at the laterally extending joint between adjacent modular ramp units U. The adjacent handrail assemblies 34 are similarly bolted together for the purposes of strength and safety.

Figure 6:
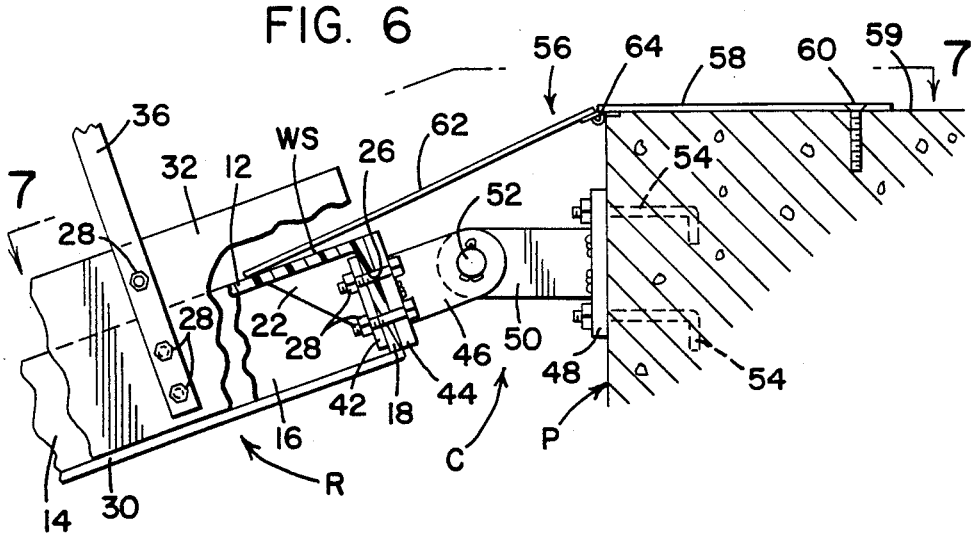
FIG. 6 is a side view, partially in section, taken along line 6—6 of FIG. 3.
Figure 7:
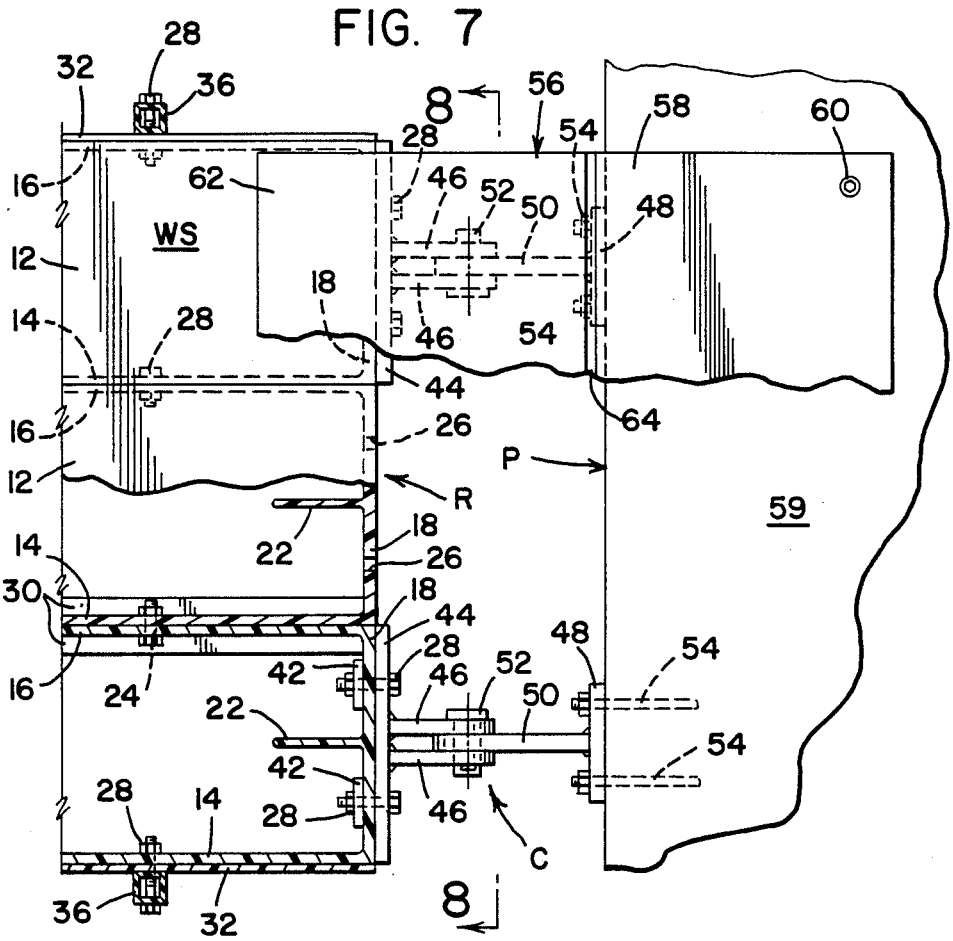
FIG. 7 is a top view, partially in section, taken along line 7—7 FIG. 6.
Figure 8:
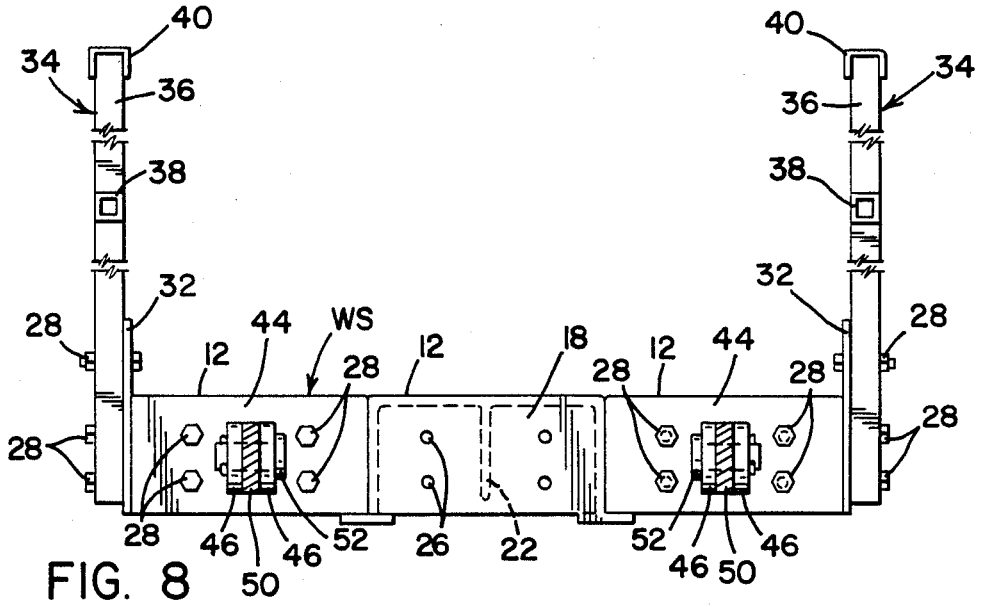
FIG. 8 is a cross sectional view taken along line 8—8 of FIG. 7.

Referring now to FIGS. 6 through 8, a connecting assembly C is provided to connect the modular ramp assembly R to the pier P. The connecting assembly C is comprised of a pair of connectors known as Follansbee Connectors. Each Follansbee Connector comprises a first steel end plate 44 having a pair of first projecting arms 46, a second steel end plate 48 having a second projecting arm 50, and a pin 52 providing a hinged connection between the first projecting arms 46 and the second projecting arm 50. The first steel end plate 44 of each Follansbee Connector is securely connected to an end plate 18 of an associated module 10 by means of bolts 28 and metal plates 42. The second steel end plate 48 is secured to the concrete pier structure by means of anchor bolts 54. The connecting assembly C further includes a handicap ramp 56 comprising a first section 58 secured to the walking surface 59 of the pier P by means of concrete fasteners 60, and a second section 62 connected to the first section 58 by means of an elongated hinge 64 and resting atop the walking surface WS of the ramp assembly R.

Figure 9:
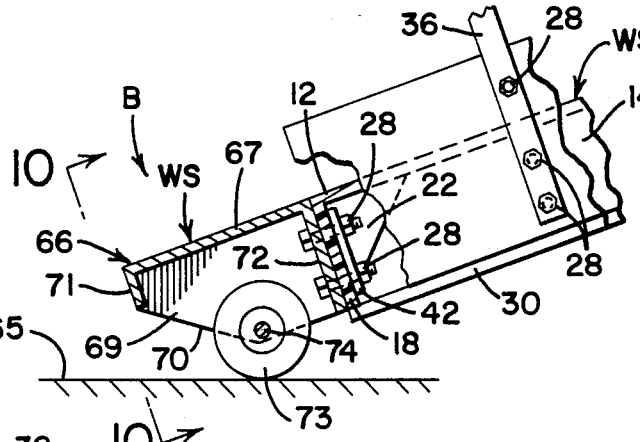
FIG. 9 is a side view, partially in section, taken along line 9—9 of FIG. 3.
Figure 10:
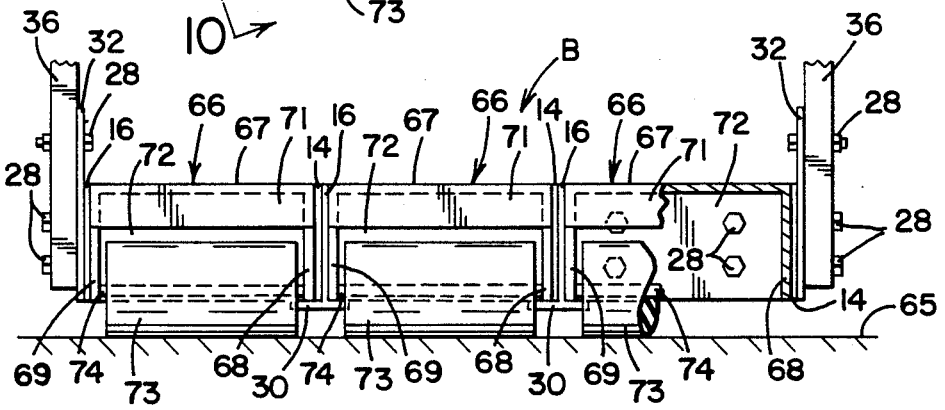
FIG. 10 is an end view taken along line 10—10 of FIG. 9.
Figure 13:
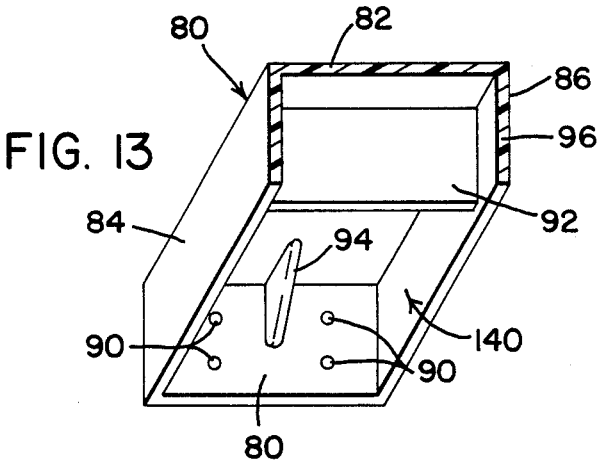
FIG. 13 is a partial pictorial view, taken in cross section, of another alternate embodiment of the present invention.
Figure 14:
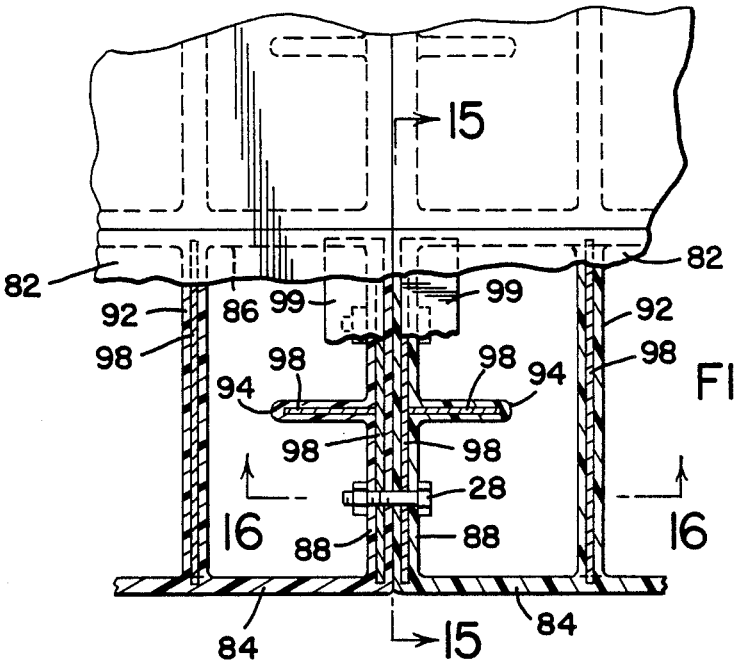
FIG. 14 is a partial top view, partly in section, of a modular pedestrian ramp assembly in accordance with the embodiment of 13.

As shown in FIG. 9 and 10, a base assembly B is provided where the modular ramp assembly R rests atop the walking surface 65 of the floating dock D. The floating dock D may comprise a modular float drum system in accordance with the invention set forth in U.S. Pat. No. 4,799,445 to Meriwether, assigned to the present assignee and incorporated herein by reference. That patented system provides an especially stable floating dock which responds to wave action and live loads uniformly along the length of the walking surface, and could accommodate placement of a pedestrian ramp at any position on the dock surface. A base unit 66 is associated with each module 10 of the lower modular ramp assembly unit U. Each base unit 66 has a channel shaped cross section with a web 67 and a pair of opposite flanges 68 and 69 each of which include tapered sections 70. A first end plate 71 extends across the tapered end of the channel shaped base unit 66, and a second end plate 72 corresponds with the end plate 18 of the associated module 10 and is connected thereto by means of bolts 28 and metal plates 42 associated with the longitudinally extending bolt holes 26. A rubber roller 73 is mounted on an axle 74 extending between the opposite side flanges 68 and 69. In response to wave action and tides which cause both vertical and horizontal movements of the floating dock D, the base assembly B comprising base units 66 is thus adapted to accommodate horizontal movement on the roller 73 as well as vertical pivotal movement as cleared by the tapered sections 70 of the side flanges 68 and 69, while at the same time extending the walking surface WS to a position closely adjacent the walking surface 65 of the floating dock D.

In accordance with the invention the modules 10 are manufactured in standard lengths and widths whereby the modular ramp units U can be constructed in various lengths and widths by selecting the corresponding combination of component modules 10. The modular ramp assembly R can likewise be constructed of selected modular units U of varying lengths to provide a total length to meet existing conditions between a floating dock and a pier. In accordance with the preferred embodiment, the modular ramp units U are constructed of laterally adjacent modules of equal length. For example, no more than three of such units constructed of modules having lengths of 10 and 15 feet would be required to construct overall modular ramp assemblies R having any total length between 10 and 40 feet defined in increments of 5 feet.

Figure 24:
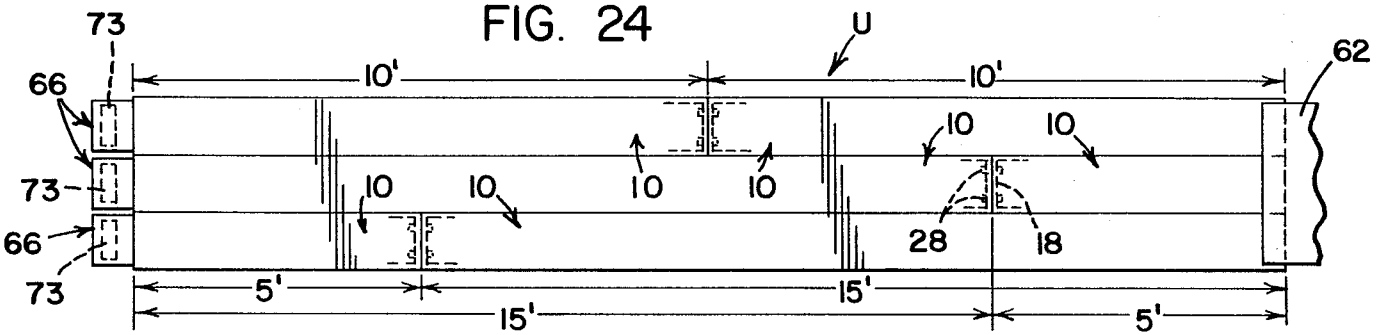

In accordance with an alternate embodiment of the invention, the modular ramp units U are constructed of laterally adjacent modules 10 of unequal length. For example, as illustrated in FIG. 24, a modular ramp unit U could comprise an offset arrangement of modules 10 having lengths of 5, 10, and 15 feet. A modular ramp assembly R having a total length of 20 feet could be provided by a single one of such units whereby a more lengthy modular structure is provided without having a joint extend entirely across the width of the structure. Likewise, only two of the latter described units would be required to construct a total length of 40 feet, whereas three of the former described units would be required. However, the preferred embodiment of the invention is found to provide a modular pedestrian ramp assembly which is sufficiently strong and easy to construct, and the alternate embodiment of the modular unit construction is presented only to illustrate specific features of the invention whereby a modular ramp assembly can be constructed to accommodate spans of varying lengths across the open water between a floating dock and a pier.

In FIG. 12 there is shown an alternate embodiment of the bolted connection between two adjacent modules 10 wherein a utility line carrier is provided in the form of an insert 75. The insert 75 is an elongated element having a T-shaped cross-section with a horizontal member 76, and a vertical member 77 of height somewhat greater than the height of the module side walls 14 and 16. The insert 75 is bolted between two adjacent module side walls 14 and 16 with the upper insert edge 78 flush with the walking surface WS of the modular ramp assembly R, and with the horizontal member 76 spaced vertically below the side walls 14 and 16 to provide a pair of elongated ledge surfaces 79 upon which utility conduits or lines 81 can run without hanging or sagging. This feature of the invention safely provides a means to run electrical power out to a floating dock since the predominantly fiberglass composition of the modular units U enables placement of power lines which might otherwise be prohibited on a metal structure, and the position of the ledge surfaces 79 is safely out of reach of persons using the ramp.

Referring now to FIGS. 13 through 16, there is shown another alternate embodiment of the invention. In this embodiment the modular components 80 differ in structural composition from the modules 10 described above with respect to the preferred embodiment. Similar to the modules 10, the modules 80 are elongated rectangular elements having a channel shaped cross section with a web 82, side wall flanges 84 and 86 including laterally extending bolt holes (not shown), end plates 88 including longitudinally extending bolt holes 90, lateral stiffeners 92, and longitudinal stiffeners 94. However, the modules 80 are composed of a fiberglass reinforced plastic material 96 formed in a mold and provided with embedded steel reinforcing elements 98 at the lateral stiffeners 92, the longitudinal stiffeners 94, and the end plates 88. The steel reinforcing elements 98 at the end plates 88 include sections 99 extending over into the webs 82 for added bending strength where longitudinally adjacent modular ramp units U are bolted together. A lightweight ramp assembly is thereby provided, and the embedded steel reinforcing elements 98 rigidify the alternate structure while also serving the same purpose at the bolted connections as the metal plates 42 in the preferred embodiment.

In FIGS. 17 through 20 there is shown yet another alternate embodiment of the present invention. Similar to the above described embodiments, the modules 100 are formed as elongated rectangular elements having a channel shaped cross section with a web 102, opposite side wall flanges 104 and 106 including laterally extending bolt holes 108, end plates 110 including longitudinally extending bolt holes 112, and lateral stiffeners 114. However, the webs 102, the sidewall flanges 104 and 106, and the lateral stiffeners 114 are composed of a solid foam material 116 surrounded by a fiberglass or a fiberglass reinforced plastic coating or shell 118. The side wall flanges 104 and 106 include metal bolt tubes 120 at the laterally extending bolt holes 108 to reinforce the bolted connections, and the end plates 110 each include an embedded steel support member 122 comprising an upper wall element 124 extending slightly into the web 102 and a pair of tapered side wall elements 126 and 128 extending slightly into the associated side wall flanges 104 and 106. The modules 100 can be also be manufactured in a mold with the fiberglass or fiberglass reinforced shell being formed around the embedded foam and steel components. This structural arrangement has a relatively low density and consequently a greater degree of buoyancy whereby the modular ramp assembly R can more easily be retrieved from the water if accidentally dropped in.

Figure 23:
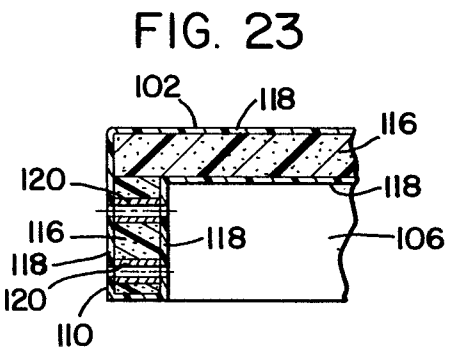
FIG. 23 is a cross sectional view of an alternate embodiment o assembly of FIG. 17; and, FIG. 24 is a top plan view of an alternate embodiment of the assembly of FIG. 3.
Figure 22:
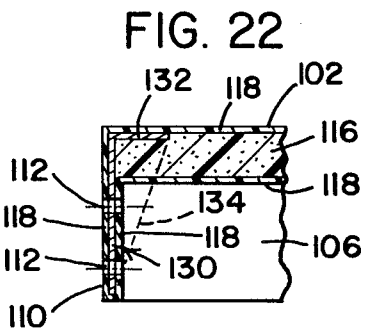
FIG. 22 is cross sectional view of an alternate embodiment of the component of FIG. 21.
Figure 21:
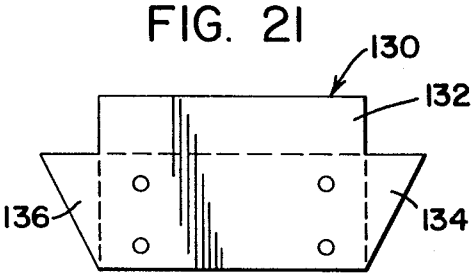
FIG. 21 is a developed view of a component of the assembly of FIG. 17.

Further regarding the embodiment of the invention shown in FIGS. 17–20, in FIG. 22 there is shown an alternate form of the embedded steel support member 122 which reinforces the end plate 110 of the module 100. This alternate embedded steel support member 130 has the same developed outline configuration of the member 122 including an upper wall element 132 and a pair of tapered side wall elements 134 and 136 as shown in FIG. 21, but the upper wall element 132 reaches the upper region of the web 102 as shown in FIG. 22 to provide greater bending strength than the element 124 at the lower region of the web 102 as shown in FIG. 20. Alternately, the end plates 110 could be formed with the same composite structure of solid foam 116 with the shell 118 as are the web 102 and the side walls 104 and 106. In this case an embedded support member is not used at the end plate, but bolt tubes 120 are provided as shown in FIG. 23.

Structural features common to each of the above described embodiments of the invention are the channel shaped cross sections of the rectangular modules and the provision of lateral stiffeners extending across the inside of the channels. These features define downwardly open air pockets 140 extending longitudinally between the stiffeners which render the modules as float members and contribute to floatation of the modular ramp units U. The invention thus provides a pedestrian ramp which has substantial resistance to sinking even if the fiberglass material alone does not provide sufficient buoyancy to float the ramp, and which is thereby more easily handled in and around the water than known ramp structures would be if merely transformed into fiberglass material.

The invention has been described with reference to the preferred embodiment. It will be appreciated that modifications or alterations which would not deviate from the present invention will occur to others upon their reading and understanding of this specification. It is intended that all such modifications and alterations be included insofar as they come within the scope of the appended claims or the equivalence thereof

Having thus described the invention, it is claimed:

1. A modular ramp assembly for connecting first and second structures respectively having first and second pedestrian walkways and comprising:

an elongated rectangular modular ramp assembly having first and second ends and comprising a plurality of elongated rectangular channel shaped float modules of rigid self-supporting form comprised of a fiberglass material, said float modules each comprising a web portion with opposite side and end flanges of equal height and defining therewith an elongated channelway closed at its opposite ends by said end flanges, said float modules being arranged in a laterally adjacent side-by-side position and being secured together into a unitary self-supporting elongated modular ramp unit structure solely by having their adjacent side flanges bolted together, with the backs of their channel web portions facing upwardly and defining a planar walking surface extending between said ramp assembly ends and with their said closed end channelways facing downwardly to form downwardly opening air pocket means in said float modules.

2. A modular ramp assembly as defined in claim 1 wherein said web portions and side and end flanges of said float modules are comprised of a molded fiberglass shell filled with polyurethane foam.

3. A modular ramp assembly as defined in claim 1 wherein the said web portions and side and end flanges of said float modules are comprised of a molded fiberglass reinforced plastic shell filled with a polyurethane foam.

4. A modular ramp assembly as defined in claim 1 wherein said float modules include a plurality of interior stiffening rib members extending laterally between said side flanges at spaced points therealong and from said web portions and approximately equal in height to said side flanges, said interior members rigidifying said module side flanges and defining with said side and end flanges and web portions a plurality of separate interior air pockets of said float modules.

5. A modular ramp assembly as defined in claim 3 wherein said float modules each include a plurality of interior rib members extending laterally between said side flanges at spaced points therealong and from said web portions and approximately equal in height to said side flanges, said interior members rigidifying said module side flanges and defining with said side and end flanges and web portions a plurality of separate interior air pockets of said float modules.

6. A modular ramp assembly as defined in claim 4 wherein said float modules each include a plurality of interior rib members extending laterally between said side flanges at spaced points therealong and from said web portions and approximately equal in height to said side flanges, said interior rib members rigidifying said module side flanges and defining with said side and end flanges and said web portions a plurality of separate interior air pockets of said float modules.

7. A modular ramp assembly as defined in claim 1 wherein said float modules are arranged in one or more rectangular modular units with each said modular unit comprising a plurality of laterally adjacent float modules of equal length.

8. A modular ramp assembly as defined in claim 1 wherein said float modules are arranged in one or more rectangular modular units with each said modular unit comprising a plurality of laterally adjacent float modules of unequal length.

9. A modular ramp assembly as defined in claim 4 wherein said modular modules are arranged in one or more rectangular modular units with each said modular unit comprising a plurality of laterally adjacent float modules of equal length.

10. A modular ramp assembly as defined in claim 4 wherein said float modules are arranged in one or more rectangular modular units with each said modular unit comprising a plurality of laterally adjacent float modules of unequal length.

11. A modular ramp assembly as defined in claim 5 wherein said float modules are arranged in one or more rectangular modular units with each said modular unit comprising a plurality of laterally adjacent float modules of equal length.

12. A modular ramp assembly as defined in claim 7 wherein said float modules are arranged in one or more rectangular modular units with each said modular unit comprising a plurality of laterally adjacent float modules of unequal length.

13. A modular ramp assembly as defined in claim 1 further comprising means for connecting said first end of said ramp assembly to said first structure with said walking surface closely adjacent to said first pedestrian walkway, said connecting means being adapted to constrain said ramp assembly from horizontal movement relative to said first structure, and to permit vertical pivotal movement of said ramp assembly relative to said first structure.

14. A modular ramp assembly as defined in claim 5 further comprising means for connecting said first end of said ramp assembly to said first structure with said walking surface closely adjacent to said first pedestrian walkway, said connecting means being adapted to constrain said ramp assembly from horizontal movement relative to said first structure, and to permit vertical pivotal movement of said ramp assembly relative to said first structure.

15. A modular ramp assembly as defined in claim 11 further comprising means for connecting said first end of said ramp assembly to said first structure with said walking surface closely adjacent to said first pedestrian walkway, said connecting means being adapted to constrain said ramp assembly from horizontal movement relative to said first structure, and to permit vertical pivotal movement of said ramp assembly relative to said first structure.

16. A modular ramp assembly as defined in claim 12 further comprising means for connecting said first end of said ramp assembly to said first structure with said walking surface closely adjacent to said first pedestrian walkway, said connecting means being adapted to constrain said ramp assembly from horizontal movement relative to said first structure, and to permit vertical pivotal movement of said ramp assembly relative to said first structure.

17. A modular ramp assembly as defined in claim 6, wherein said float modules are arranged in one or more rectangular modular units with each said modular unit comprising a plurality of laterally adjacent float modules of equal length.

18. A modular ramp assembly as defined in claim 6, wherein said float modules are arranged in one or more rectangular modular units with each said modular unit comprising a plurality of laterally adjacent float modules of unequal length.

19. A modular ramp assembly as defined in claim 1, wherein a plurality of said elongated modular ramp units are secured together in end-to-end relation into a unitary self-supporting elongated multi-unit modular ramp assembly solely by having their adjacent said end flanges of the respective modules of said modular ramp units abutting one another and bolted together.

20. A modular ramp assembly as defined in claim 4, wherein the said float modules each include a plurality of longitudinally extending interior stiffening rib members extending between the said web portions of said channel shape float modules and said end flanges thereof.

21. A modular ramp assembly as defined in claim 1, wherein one of the adjacent bolted together side flanges of each pair of said laterally adjacent bolted together modules is provided with a horizontal flange extending longitudinally along its lower edge and underlying and on which the lower edge of the other one of the said adjacent side flanges rest to provide a supplemental support therefor anD for the bolted connections of said adjacent side flanges of said laterally adjacent modules.

22. A modular ramp assembly as defined in claim 1, wherein an elongated insert member of inverted T-shape cross-section is bolted between adjacent bolted together side flanges of a pair of said laterally adjacent modules, with the cross flange of said T-shape insert member disposed horizontally below and spaced from the lower edges of said adjacent side flanges, to provide a pair of horizontal ledge surfaces extending along the length of said laterally adjacent modules for supporting thereon one or more utility conduits.

23. A modular ramp assembly as defined in claim 1, wherein a handrail assembly is mounted on and extends longitudinally along each respective outer side of said ramp assembly, each handrail assembly comprised of a plurality of vertical fiberglass support post members bolted at their lower ends to an outermost one of the said side flanges of said laterally adjacent float modules and a horizontal fiberglass handrail member extending the length of the said laterally adjacent bolted together float modules of said ramp assembly and bolted to the upper ends of said support post members.

24. A modular ramp assembly as defined in claim 19, wherein the said float modules of said modular ramp units are composed of a fiberglass reinforced plastic material and have steel reinforcing plates embedded in their said end flanges.

25. A modular ramp assembly as defined in claim 19, wherein the said float modules of said modular ramp units are composed of a fiberglass reinforced plastic material and each include a plurality of longitudinally extending interior stiffening ribs extending between the said web portions of said channel shape float modules and said end flanges thereof, said float modules having steel reinforcing members comprising plate sections respectively embedded in their said end flanges and in their longitudinally extending stiffening ribs.

26. A modular ramp assembly as defined in claim 5, wherein the said float modules of said modular ramp units are composed of a fiberglass reinforced plastic material and have steel reinforcing plate members embedded in said laterally extending stiffening rib members.

27. A modular ramp assembly as defined in claim 25, wherein the said float modules of said modular ramp units also include a plurality of interior stiffening rib members extending laterally between the said side flanges of the respective modules at spaced points therealong and from said web portions and approximately equal in height to said side flanges, and said laterally extending stiffening rib members also having steel reinforcing plate members embedded therein.

28. A modular ramp assembly as defined in claim 25, wherein the said steel reinforcing members also have horizontally extending plate sections embedded in and extending a short distance into the said web portions of the respective float modules.

29. A modular ramp assembly as defined in claim 4, wherein the said web portions, side flanges, and lateral stiffening rib members of the float modules are composed of a solid plastic foam material encased in a fiberglass reinforced plastic shell and a plurality of said elongated modular ramp units are secured together in end-to-end relation solely by having their adjacent said end flanges of the respective modules of said modular ramp units abutting one another and bolted together, said end flanges of each of said modules being comprised of the two downturned and overlayered end wall portions of the fiberglass reinforced plastic shell of said modules, and said modules having steel reinforcing members comprising end plate sections bolted between the said two overlayered end wall portions of said modules, and top and side plate sections respectively embedded in the said web portions and side flanges of said modules.

* * * * *